US006447375B2

(12) United States Patent
Yancey et al.

(10) Patent No.: US 6,447,375 B2
(45) Date of Patent: Sep. 10, 2002

(54) POLISHING METHOD USING A RECONSTITUTED DRY PARTICULATE POLISHING COMPOSITION

(75) Inventors: Paul J. Yancey, Charlotte, NC (US); Robert L. Rhoades, Phoenix, AZ (US)

(73) Assignee: Rodel Holdings Inc., Wilmington, DE (US)

( * ) Notice: Subject to any disclaimer, the term of this patent is extended or adjusted under 35 U.S.C. 154(b) by 0 days.

(21) Appl. No.: 09/837,506

(22) Filed: Apr. 18, 2001

Related U.S. Application Data

(60) Provisional application No. 60/198,354, filed on Apr. 19, 2000.

(51) Int. Cl.[7] ..... B24B 1/00

(52) U.S. Cl. ..... 451/60; 451/36; 451/41; 451/286; 451/287; 451/446

(58) Field of Search ..... 451/36, 41, 60, 451/286, 287, 446

(56) References Cited

U.S. PATENT DOCUMENTS

| | | | | |
|---|---|---|---|---|
| 5,389,352 A | * | 2/1995 | Wang | 423/263 |
| 5,391,258 A | | 2/1995 | Brancaleoni et al. | |
| 5,476,606 A | | 12/1995 | Brancaleoni et al. | |
| 5,554,126 A | | 8/1996 | Ota et al. | |
| 5,693,239 A | | 12/1997 | Wang et al. | |
| 5,756,398 A | | 5/1998 | Wang et al. | |
| 5,769,689 A | | 6/1998 | Cossaboon | |
| 5,770,103 A | | 6/1998 | Wang et al. | |
| 4,786,325 A | | 11/1998 | Melard et al. | |
| 5,586,848 A | | 1/1999 | Loncki et al. | |
| 5,932,486 A | | 8/1999 | Cook et al. | |
| 5,951,724 A | | 9/1999 | Hanawa et al. | |
| 6,001,269 A | | 12/1999 | Sethuraman et al. | |
| 6,030,899 A | | 2/2000 | Cook et al. | |
| 6,069,080 A | | 5/2000 | James et al. | |
| 6,074,546 A | | 6/2000 | Sun et al. | |
| 6,099,394 A | | 8/2000 | James et al. | |
| 6,171,352 B1 | | 1/2001 | Lee et al. | |
| 6,241,586 B1 | | 6/2001 | Yancey | |
| 6,309,560 B1 | | 10/2001 | Kaufman et al. | |

FOREIGN PATENT DOCUMENTS

| | | | | |
|---|---|---|---|---|
| EP | 1036632 A | * | 9/2000 | |
| EP | 1 036 632 | * | 9/2000 | ..... B24B/37/04 |
| WO | WO 9602319 A | * | 2/1996 | |
| WO | WO 96382262 A1 | | 12/1996 | |
| WO | WO 9847661 A | * | 10/1998 | |

* cited by examiner

*Primary Examiner*—Joseph J. Hail, III
*Assistant Examiner*—Shantese McDonald
(74) *Attorney, Agent, or Firm*—Gerald K. Kita; Kenneth A. Benson; Konrad Kaeding

(57) ABSTRACT

A polishing method uses a dry particulate solids composition that is reconstituted into an aqueous composition for delivery to a polishing apparatus. In one aspect of the invention, the dry particulate solids composition is provided in a package size that is just substantially sufficient to make a reconstituted slurry for completing the polishing of a predetermined number of work pieces. The quantity of dry particulate solids delivered to a reconstitution apparatus can be an amount appropriate for polishing one work piece or a small number of work pieces, or the system can operate in larger batches or a continuous flow mode. The reconstituted aqueous polishing solution can be monitored for physical or chemical properties, filtered, blended with other chemical mixtures, or modified in other ways prior to being used in the polishing apparatus.

22 Claims, 4 Drawing Sheets

POLISHING METHOD USING A RECONSTITUTED DRY PARTICULATE POLISHING COMPOSITION

This application claims priority from Provisional application Ser. No. 60/198,354, filed Apr. 19, 2000.

FIELD OF THE INVENTION

This invention relates, generally, to polishing slurries and their use in polishing systems and, more particularly, to methods for polishing work pieces using a reconstituted dry particulate polishing composition.

BACKGROUND

Polishing formulations for the chemical-mechanical-polishing (CMP) of integrated circuit wafers, as well as polishing compounds for high technology optical components or other ultra fine surface finish applications, typically consist of an aqueous dispersion of solids (the abrasives) combined with a variety of chemical constituents. Such commercial materials can be sold as a single mixture of solids or in several parts, one part containing the abrasive component in a concentrated form, and the other part containing the chemical component(s) in a concentrated form.

As the technology of CMP polishing has become more critical, complex chemical and abrasive systems have been developed. These aqueous formulations must exhibit long shelf life and good stability so that the materials do not change while in storage. Uncontrolled or excessive physical changes during storage can render these formulations unusable for their intended purpose. For example, when a mixture of solids is stored and the solids settle in the storage container to form a hard, sediment, the mixture is no longer readily usable by the customer. Also, if the chemical system undergoes significant changes in the concentrations of the reactive species, the slurry can be rendered unusable for its intended purpose.

Frequently the main reason for physical and chemical instability is that slurries are typically packaged for sale as aqueous dispersions. More recently, CMP polishing systems have been developed in which the abrasives are contained in a polishing pad and are not contained in the liquid polishing composition provided at the polishing interface. However, the liquid polishing compositions used with these types of polishing pads often exhibit to the same types of chemical instability observed in the conventional aqueous dispersion slurries.

Preparing a solid particulate slurry composition and drying the composition can address the instability of a liquid-dispersion polishing slurry. The stability issues for both the chemical and abrasive constituents can be minimized by eliminating the "aqueous" part of the system. Accordingly, a dry, particulate slurry is prepared having a composition exactly as the final end user would use it. By preparing a such a dry slurry composition, the slurry is effectively "frozen in time" so that it will be exactly as the end user wants it, up to six months or longer after the dry slurry composition is originally prepared. Such a slurry composition is disclosed in co-pending, commonly-assigned patent application filed Oct. 6, 1999 and having Ser. No. 09/413,083. In accordance with the disclosed method, the dry particulate slurry composition is simply reconstituted prior to use. While the development of dry slurry preparation methods has greatly improved the ability to store slurry compositions over extended periods of time, further development of methods of using reconstituted slurries can provide even more improved polishing methods.

BRIEF SUMMARY

The present invention provides a polishing method using a dry particulate solids composition comprised of a chemical-mechanical polishing composition comprising chemicals useful for CMP that has had substantially all water removed therefrom and the can be reconstituted into a chemical-mechanical polishing composition ready for use. This composition is delivered via one of a variety of methods to an apparatus for reconstitution into an aqueous polishing solution. The dry particulate solids composition may comprise abrasive particles, an oxidizing agent, a complexing agent, a surface passivating agent, a surfactant, a dispersant, or any other type of compound used in slurries for chemical-mechanical polishing.

The quantity of dry particulate solids delivered to the reconstitution apparatus can be an amount appropriate for polishing one work piece or a small number of work pieces, or the system can operate in larger batches or a continuous flow mode. The reconstituted aqueous polishing solution may then be monitored for physical or chemical properties, filtered, blended with other chemical mixtures, or modified in other ways prior to being used in a polishing operation.

In one embodiment, the inventive process includes providing a dry particulate solids composition and reconstituting an amount of the dry particulate solids composition to form a quantity of an aqueous composition. The amount of the aqueous composition is just substantially sufficient to complete the polishing of the predetermined number of work pieces.

In another embodiment, the process of the invention includes determining a fixed number of work pieces to be polished and preparing a quantity of the dry particulate solids composition that is just sufficient to form an amount of reconstituted slurry for completing the polishing the fixed number of work pieces.

DETAILED DESCRIPTION OF THE PREFERRED EMBODIMENTS

Figure 1:
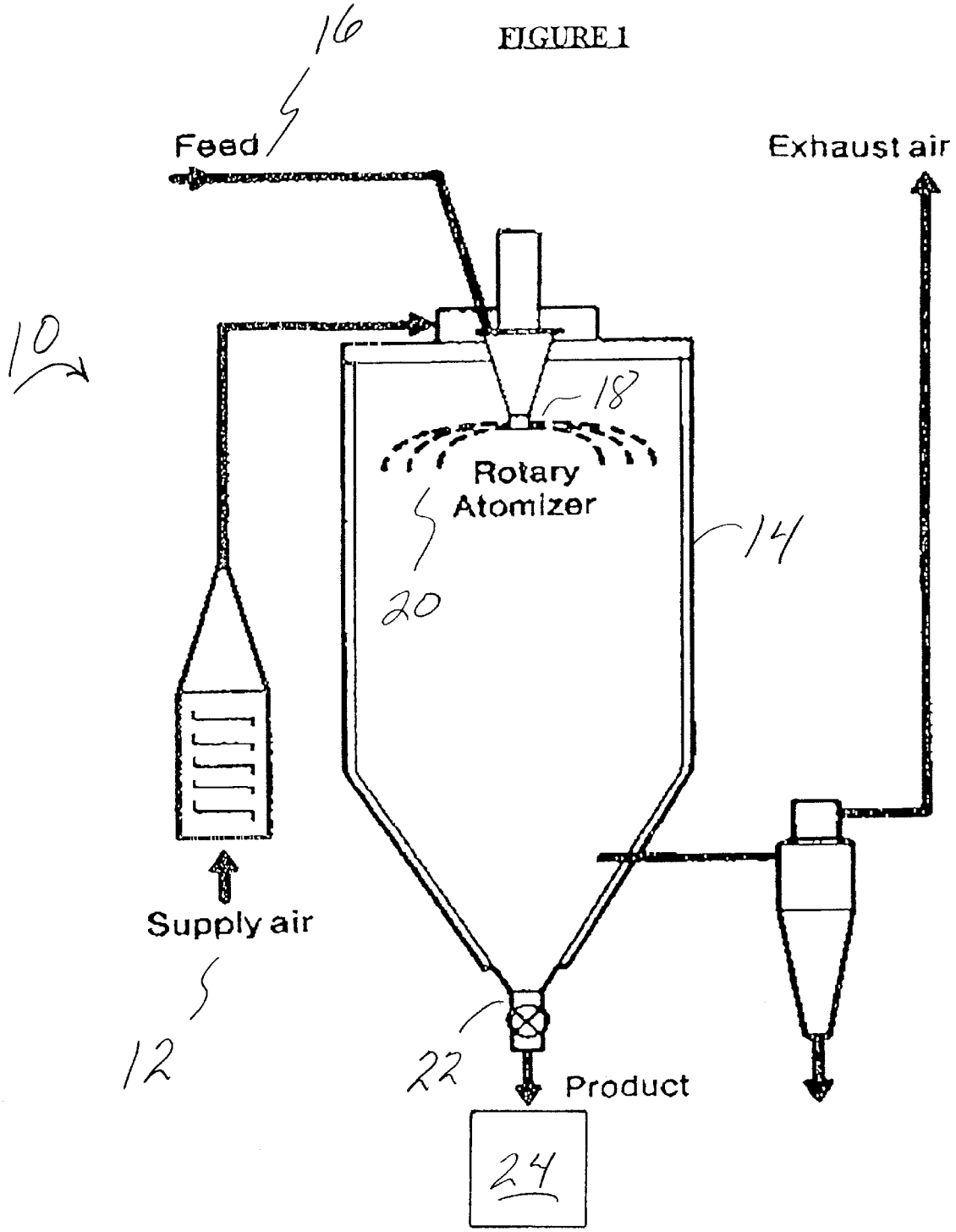
FIG. 1 is a schematic diagram of a typical spray dryer useful for practicing a process in accordance with the invention.

This invention provides a means of preserving abrasive and chemical ratios of a polishing composition without the destabilizing and aging effects of aqueous dispersions. The abrasive and chemicals are mixed together as if they were being prepared for the end user's immediate use, or they are prepared as a concentrate with the ratios of the components being all related by a common multiple. Immediately after the polishing slurry is manufactured, it is dewatered by spray drying, freeze drying, or any number of drying or dewatering methods that exist. The resulting dry particulate solids composition, usually in the form of a flowable powder, can be packaged in conventional bags or other non-reactive containers and stored indefinitely without substantial degradation.

A further advantage brought about by this invention is that the weight of the product is reduced by as much as about 70% to about 80%, which is a considerable cost savings when one considers shipment of liquid, aqueous slurry worldwide.

When the slurry is ready to be used, the end user may reconstitute the dry particulate solids composition by adding the required amount of water and dispersing with a high shear disperser. Other chemicals can also be added, if desired, without compromising the utility of the present invention. The resulting slurry is filtered and is ready for use in the CMP polishing operation. The slurry could also be monitored before being used for pH and other properties, which could be appropriately adjusted.

When providing a single serving of slurry (for the polishing of a given number of work pieces or one polishing cycle), one could mix the next batch of slurry while the current batch of slurry is being used for polishing. Preferably the mixing units are self-cleaned between batches because successive batches of slurry may have different compositions. Preferably the mixing units are composed of materials that will not contaminate slurries.

The resulting polishing slurry does not acquire unwanted aggregates as one might expect. This is thought to be due to the complete and thorough dispersed state that the slurry is brought to just prior to drying. As the colloidal dispersed mixture of components dries, the abrasive grains are surrounded by the uniform presence of the drying dissolved salts, which in effect protect the abrasive particles from agglomerating with each other. As the salts are solvated during the reconstitution process, the abrasive particles are released in essentially the same state they existed prior to being dried.

Typical submicron abrasives used in chemical-mechanical polishing slurries are oxides such as alumina, silica, ceria, titania, germania, zirconia, and the like. Generally abrasive particles are used in slurries for CMP at about 1% to about 30% by weight. Preferred are alumina, silica, ceria, titania, or mixtures thereof at about 3% to about 15% by weight.

Types of chemicals useful in CMP operations are oxidizing agents, chemical etchants, dispersing agents, surfactants, complexing agents, silica rate suppressing agents, passivating agents, silica protecting agents, buffers, and inhibitors, all of which may be present in the dried slurries of the present invention.

Commonly hydroxides, such as potassium hydroxide, ammonium hydroxide, and sodium hydroxide, and various amines have been used as dispersing agents for CMP slurry abrasives. It has been found that a class of compounds known as amino alcohols may also be useful.

An oxidizing agent is usually a component of a chemical-mechanical polishing slurry to oxidize a metal layer to its corresponding oxide, such as oxidizing tungsten to tungsten oxide. The layer is mechanically polished to remove the tungsten oxide from the layer. Although a wide range of oxidizing components may be used, preferred components include oxidizing metal salts, oxidizing metal complexes, iron salts such as nitrates, sulfates, EDTA, citrates, potassium ferricyanide and the like, aluminum salts, sodium salts, potassium salts, ammonium salts, quaternary ammonium salts, phosphonium salts, peroxides, chlorates, perchlorates, permanganates, persulfates, iodates, and mixtures thereof. Typically, the oxidizing component is present in the slurry in an amount sufficient to ensure rapid oxidation of a metal layer while balancing the mechanical and chemical polishing components of the slurry. Oxidizing agents are typically present in a chemical-mechanical slurry from about 0.5% to about 15% by weight, and preferably in a range from about 1% to about 7% by weight.

The dry particulate solids compositions of this invention may optionally further comprise compounds that act as complexing agents or chelating agents for $SiO_2$. Such complexing agents and chelating agents are described in U.S. Pat. No. 5,391,258 and U.S. Pat. No. 5,476,606, which are incorporated by reference herein. These compounds must have at least two acid groups present in the structure that can affect complexing to the silica. Acid species are defined as those functional groups having a dissociable proton. These include, but are not limited to, carboxyl, hydroxyl, sulfo and phospho groups. Carboxyl and hydroxyl groups are preferred as these are present in the widest variety of effective species. Particularly effective are structures which possess two or more carboxyl groups with hydroxyl groups in an alpha position, such as straight chain mono- and di-carboxylic acids and salts including, for example, malic acid and malates, tartaric acid and tartarates and gluconic acid and gluconates. Also effective are tri- and polycarboxylic acids and salts with secondary or tertiary hydroxyl groups in an alpha position relative to a carboxyl group such as citric acid and citrates. Also effective are compounds containing a benzene ring such as ortho di- and polyhydroxybenzoic acids and acid salts, phthalic acid and acid salts, pyrocatecol, pyrogallol, gallic acid and gallates and tannic acid and tannates. These complexing agents may be used in slurries for CMP at about 0.1% to about 7% by weight. Preferably they are present in a range from about 2% to about 4% by weight.

In addition the slurry composition may include a chemical etchant that is substantially free of metal ions. Typical etchants include persulfate salts, nitrate salts, sulfate salts, phosphate salts, citrate salts, oxalate salts, mixtures thereof, and the like. Preferably, the etchant is a non-metallic persulfate salt such as ammonium persulfate. The etchant facilitates the solubilization of the metal where the chemical mechanical polishing is taking place, thus allowing the metal to be dissolved in the aqueous dispersion. These chemicals are generally found in CMP slurries in a range from about 1% to about 10% by weight. Preferably they are present in a range from about 2% to about 7% by weight.

Often a chemical-mechanical polishing slurry will comprise a corrosion inhibitor that is substantially free of metal ions. Suitable corrosion inhibitors include benzotriazole (BTA), mercaptobenzothiazole (MBT), and other corrosion inhibitors that are typically used with metals such as copper to reduce the deleterious effects of corrosion on the exposed metal surfaces during and after the polishing operation. Typically corrosion inhibitors are present in chemical-mechanical polishing slurries at less than about 1% by weight. Preferably they are present in the range from about 0.05% to about 0.6% by weight.

The first step in preparing the dry particulate solids composition is to determine the exact ratio of all of the components in a polishing slurry as they exist at the time of use. For example, for a slurry including about 5% solid abrasive and about 7% chemical constituents, and where there are two chemical constituents, the total composition by weight of a ready to use formulation may have the following composition:

| | |
|---|---|
| Solid Abrasive | 5% |
| Chemical A | 3% |
| Chemical B | 4% |
| Water | 88% |

After the water has been removed, the solids and dissolved solids will be left in the ratio of 5/3/4. In spray drying it is generally good to have the pre-dried slurry concentrate with the highest solids content possible, to reduce the amount of water that has to be evaporated, thus reducing the cost and increasing the throughput. Thus, when making a concentrate for drying, one should use the constituents in the ratio of 5/3/4 times some factor. This factor is typically determined by a solubility limit of one of the components, or a maximum solids loading limitation. For example, wherein chemical A has a large or unlimited solubility and where Chemical B is only soluble to a maximum concentration of about 10%, then in order to make a completely homogeneous dispersion where all of the chemical components are dissolved, the maximum concentration factor would be 0.10/0.04 or 2.5. Thus, the concentration of the components of the pre-dried slurry is determined by multiplying each component except the water by the factor 2.5. The final concentration for the drying slurry is:

| | |
|---|---|
| Solid Abrasive | 2.5 × 5 = 12.5% |
| Chemical A | 2.5 × 3 = 7.5% |
| Chemical B | 2.5 × 4 = 10.0% |
| Water | Balance 70.0% |

This formulation, when dried, will yield a dry particulate solids composition with the three active constituents having the ratio of 5/3/4 as in the ready to use slurry but by concentrating the spray dryer starting material, the spray drying operation is more efficient. The drying technique can be one of many including spray drying, freeze drying, flash drying, vacuum drying, heated pan or conveyor drying, etc. In a preferred technique spray drying is used because it offers an easily controlled final product with respect to particle size, % moisture, and reproducibility of product.

A schematic of a typical spray dryer is shown in FIG. 1. A spray dryer 10 utilizes the combination of hot air 12 circulating in a large tank 14 into which a solid/liquid slurry 16 is sprayed, either by rotary atomization 18 or high pressure aspiration, into the heated air wherein the water content is almost immediately removed and water-free solid particles 20 are formed. As the particle progresses further in the air stream, the particle is further dried until it reaches an exit point 22 in tank 14 and is captured by a cyclone or collection container, generally shown as element 24. In many dryers the coarser material is captured in a product collection container and the smaller or finer material (fines) are collected in a cyclone separator. In the present invention, both collection methods are satisfactory as the sizes of the dried particles are not an issue.

Figure 2:
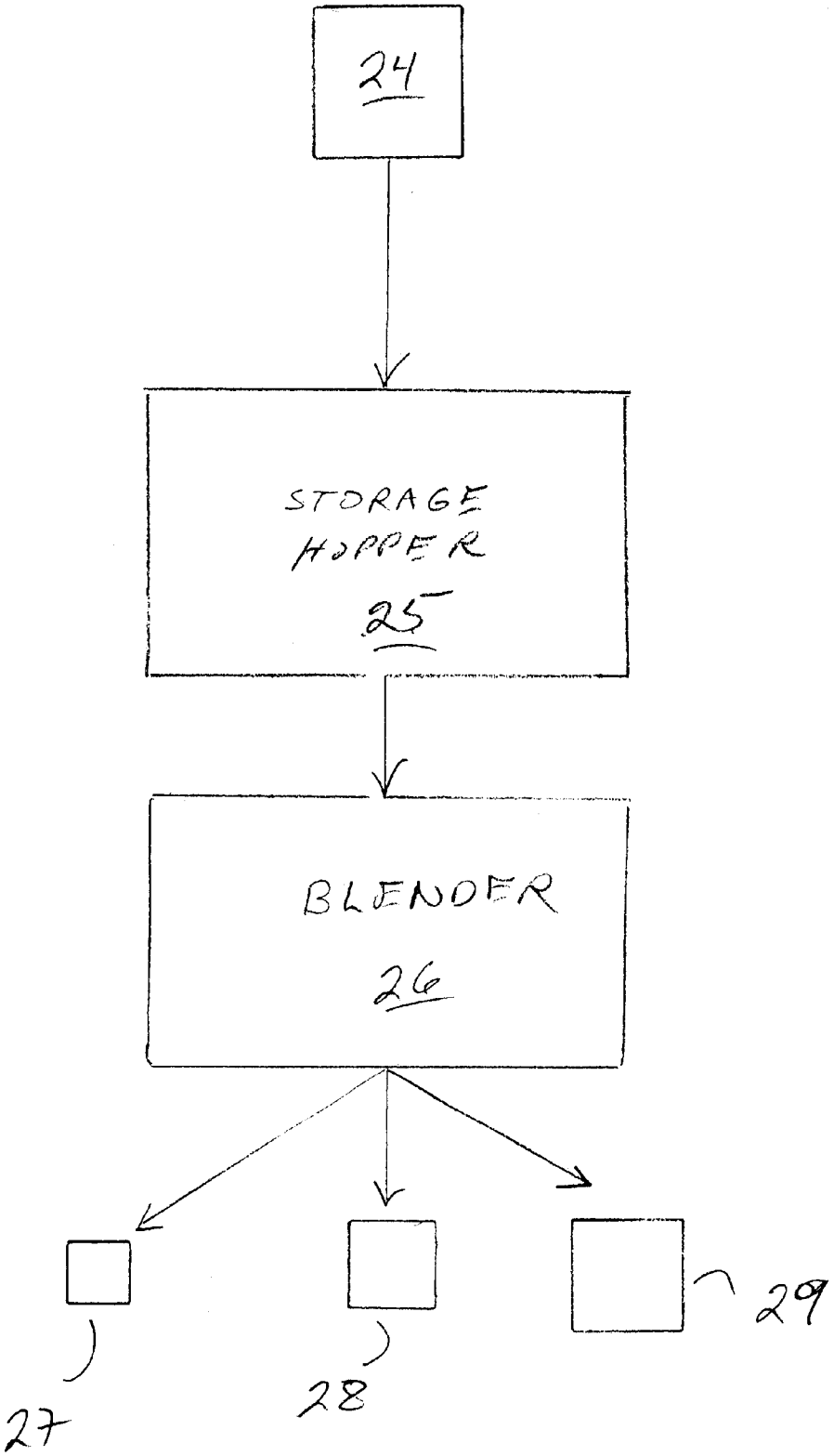
FIG. 2 is schematic diagram illustrating a post-drying process in accordance with the invention.

The post-drying processing carried out in accordance with the invention is schematically illustrated in FIG. 2. After collection, the dried powder is transported to a storage hopper 25 where the dried powder is collected to make a large batch or lot. The dried powder is then dry blended in a large double cone blender 26, or similar type of device, so that the dried powder lot is completely homogeneous. By blending a large dry lot, the size of the individual blended lot can be much larger than its liquid equivalent, because the weight and volume of the water has been removed from the concentrate. A large homogeneous lot size is particularly important for the semiconductor industry, where each new lot of material must be checked or qualified prior to use.

After blending, the preparation of the dry particulate solids composition is complete. The dry particulate solids composition is packaged in any suitable type of container, such as a plastic lined fiber drum, or a plastic lined paper bag. It is desirable for the container size to be equivalent to the amount of dry particulate solids composition that is likely to be used in each polishing campaign after reconstitution. In accordance with the invention, the dry particulate solids composition can be packaged in one a variety of package sizes. The particular package size will depend upon the intended end use of the dry particulate solids composition. For example, for a single serving of slurry to be used to polish a single work piece, or a small number of work pieces, the dry particulate solids composition is packaged in a single serving package 27. For the polishing of a larger batch of work pieces, a batch package 28 can be used to store the dry particulate solids composition and, for several batches, a multiple batch package 29 can be filled with the dry particulate solids composition. By packaging the dry particulate solids composition in packages sized for polishing a particular number of work pieces, a polishing process can be carried out with an optimal amount of slurry. Accordingly, the quality of the polishing process can be improved and the overall cost of the polishing process can be reduced.

Figure 3:
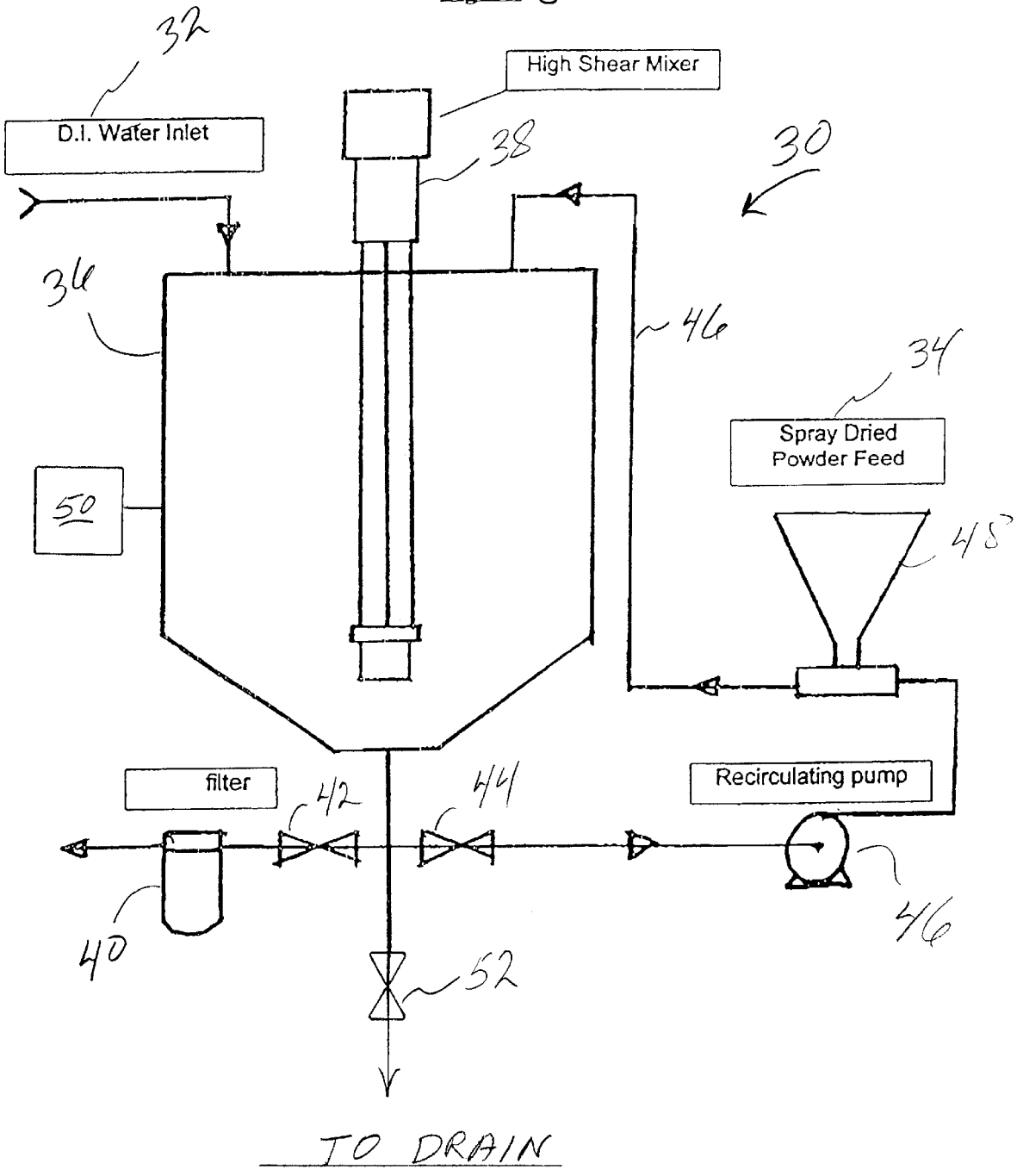
FIG. 3 is a schematic diagram of a typical slurry reconstitution apparatus useful for practicing a process in accordance with the invention.

Reconstitution of the dry particulate solids composition may be carried out in an exemplary mixing unit 30, as shown in the schematic diagram of FIG. 3. The equipment includes a suitable means of introducing a measured amount of deionized water 32 and powdered slurry 34 to a mixing tank 36. Mixing unit 30 includes a high speed rotor stator 38 vertically mounted in mixing tank 36. High speed rotor stator 38 is capable of providing very high shear. After the reconstituted slurry has been mixed adequately (generally determined by how much energy per gallon has been expended on the product) the reconstituted slurry is pumped from the reconstituting equipment through a sub-micron filter system 40 and to a polishing system or into a day tank (not shown). From the day tank, the reconstituted slurry can be recirculated and used by the end user in a polishing process.

Those skilled in the art will recognize that numerous modifications of the slurry reconstitution system can be made. For example, the capacity of mixing tank 36 can vary from about 1 liter to about 10 liters. Further, mixing unit 30 can be a stand-alone system, or a system component of a polishing apparatus. In yet another alternative, mixing unit 30 can be configured to deliver a steady quantity of reconstituted slurry at a rate substantially the same as the consumption rate of an associated polishing apparatus having a slurry consumption rate of, for example, about 0.5 liter to about 1.5 liters per work piece. In a still further alternative, the dry particulate solids composition can be fed directly into mixing tank 36 in the form of a pellet or tablet, or the pellets can be ground and used as powder slurry 34. Accordingly, mixing unit 30 is only one example of a variety of equipment configurations possible for reconstituting a dry particulate solids composition in accordance with the invention.

In a reconstitution process carried out in accordance with one embodiment of the invention, mixing tank 36 is charged with deionized water 32 and valve 42 is closed and valve 44 is opened. Mixing tank 36 can be charged with the total amount of water to be used in a single fill, or the water can be added slowly over a period of time as the reconstitution process is carried out. Once at least some water is introduced into mixing tank 36, a recirculation pump 46 is activated to charge a recirculation line 47 with water and rotor stator 38 is activated. A quantity of dry particulate solids composition 34 is introduced into recirculation line 47 at a controlled rate by a powder feed 48. The recirculation of slurry through recirculation line 47 is continued until a desired slurry concentration and viscosity is obtained. A monitoring system 50 continuously analyzes the physical and chemical properties of the slurry, for example, the percentage of solids, and pH and the like. Although, monitoring system 50 is depicted as connected to mixing tank 36, the monitoring function can also be carried out at some point along recirculation line 47.

Once a desired slurry is obtained, rotor stator 38 is shut off and valve 42 is opened to deliver a predetermined quantity of reconstituted slurry through filter system 40. Depending upon the particular application, the reconstituted slurry is delivered to a day tank, or directly to the platen of a polishing apparatus. In yet another alternative embodiment, the day tank could be utilized as the mixing and dispersing vessel. During slurry delivery, recirculation pump 46 can remain active to maintain the consistency of the slurry by, for example, preventing the settling of solids in mixing tank 36. After dispensing the slurry, valve 42 is closed and water is flushed through mixing tank 36 and recirculation line 47. Then, a drain valve 52 is opened and the contents of mixing tank 36 and recirculation line 47 are flushed to a drain.

Using currently practiced methods for aqueous slurries, if the slurry is a two-component system, the component containing the solids typically must be premixed to redistribute the solids in the container prior to dispensing into a day tank. If this is not done, the weight percent of solids in the final mixture will be incorrect. Similarly, the second component should be pre-mixed to homogenize the solution prior to delivery to the day tank or to a polishing system. Both of these components generally require some type of metering, either by weight or volume, in addition to the metering of water in some concentrated systems. This mixture must then be filtered to remove any contamination from the operation.

In the present invention, preferably, no pre-mixing is required, because no settling or stability issues are involved. Preferably, a pre-packaged dry particulate solids composition, described above, is introduced through powder feed 48. Alternatively, the dry particulate solids composition can be merely weighed (or pre-weighed for each size day tank), or poured or educed into mixing tank 36 containing the correct volume of water, and mixed. Additionally, other chemicals, such as hydrogen peroxide and organic compounds and the like can be added during the mixing process. The organic compounds can include surfactants, chelating agents, mild acids, biocides and the like.

Without further elaboration it is believed that one skilled in the art can, using the foregoing description, practice the invention to its fullest extent. The following specific Examples are, therefore, to be construed as merely illustrative and are not intended to limit the disclosure in any way whatsoever.

EXAMPLE 1

A slurry formulated for polishing copper in integrated circuit applications was prepared. This slurry typically has a very short shelf life as a one component slurry, and only a short shelf life (several weeks) as a two component slurry, because several of the components react with one another. Another component is light sensitive in the liquid form. The drying of this slurry is further complicated by the fact that several of the salts are ammonia salts and easily decomposed by heat.

The slurry was prepared as a "2×concentrate" to facilitate the spray drying operation. A "2×concentrate" is a slurry that is twice as concentrated in each of the solids and dissolved solids as a slurry normally used for polishing. The pre-dried slurry had the following composition:

| | |
|---|---|
| Phosphoric acid: | 11.2% |
| Ammonium Phosphate | 8.5% |
| Ammonium persulfate: | 8.5% |
| Organic corrosion inhibitor | 0.3% |
| Titanium dioxide | 9.9% |
| D.I. water | Balance |

The ingredients were mixed together and dispersed with a Hill rotor stator mixer until the temperature rise in the tank reached about 10° C. Within about three days a portion of the mixture was spray dried in an APV Laboratory Spray Dryer having an electric air heater, a rotary atomizer, and a peristaltic feed pump with variable speed motor. The dried powder was collected from the bottom of the dryer as well as the cyclone separator. The atomizer was adjusted to prevent product from sticking on the walls of the dryer, and the inlet air temperature and feed rate were adjusted to obtain an outlet air temp of about 80° C. to about 85° C. The powder was sealed in a plastic bag awaiting further processing. The remaining slurry was stored in a closed container as a liquid awaiting further testing.

The details of a spray drying test are listed in Table 1 below. The test was carried out using different dryer conditions.

TABLE 1

| Test | Inlet Temp. (° C.) | Outlet Temp. (° C.) | Feed Rate (mL/min) | Atomizer speed (rpm) |
|---|---|---|---|---|
| I | 250–260 | 80–85 | 130 | 49000 |
| II | 180–185 | 80–85 | 65 | 41000 |

The two tests denote two different inlet temperatures at which the dryer was operated to determine if inlet temperature had an effect on the decomposition of volatile or heat sensitive components. No statistically significant difference was observed between the two inlet temperatures in terms of either the physical properties of the powders or the polishing performance of the reconstituted slurries. This result is also shown in Table 2 below for the physical properties of the slurries. The polishing tests using reconstituted Test I and Test II powders are referenced in the examples below.

Another means of monitoring the usefulness of this invention is in the analytical determination of the primary active ingredient in the slurry, the ammonium persulfate. This component is both sensitive to heat and to light in the aqueous state. The two dried slurries and the concentrate from which they came were analyzed one week after the spray drying was performed. The results are shown in Table 2 below. All concentrations were made in the ready to use concentration.

TABLE 2

| Slurry | % persulfate | PH | median particle size | mean particle size |
|---|---|---|---|---|
| Reconstituted test I | 4.34 | 2.3 | 0.178 | 0.233 |
| Diluted liquid concentrate, 10 d. old | 4.17 | 2.3 | 0.177 | 0.225 |
| Reconstituted test II | 4.33 | 2.3 | 0.178 | 0.227 |

The data shown in Table 2 indicate that the spray drying preserves the efficacy of the least stable chemical component. Even within ten days of its manufacture, the strength of the oxidizing component, ammonium persulfate, was decreasing within the single part slurry concentrate.

It can be seen from the data in Table 2 that the persulfate concentration did not change with increased inlet temperature and remained exactly as it was intended in the original composition. The particle size of the two dried materials came back to exactly what they had been before the drying operation.

Figure 4:
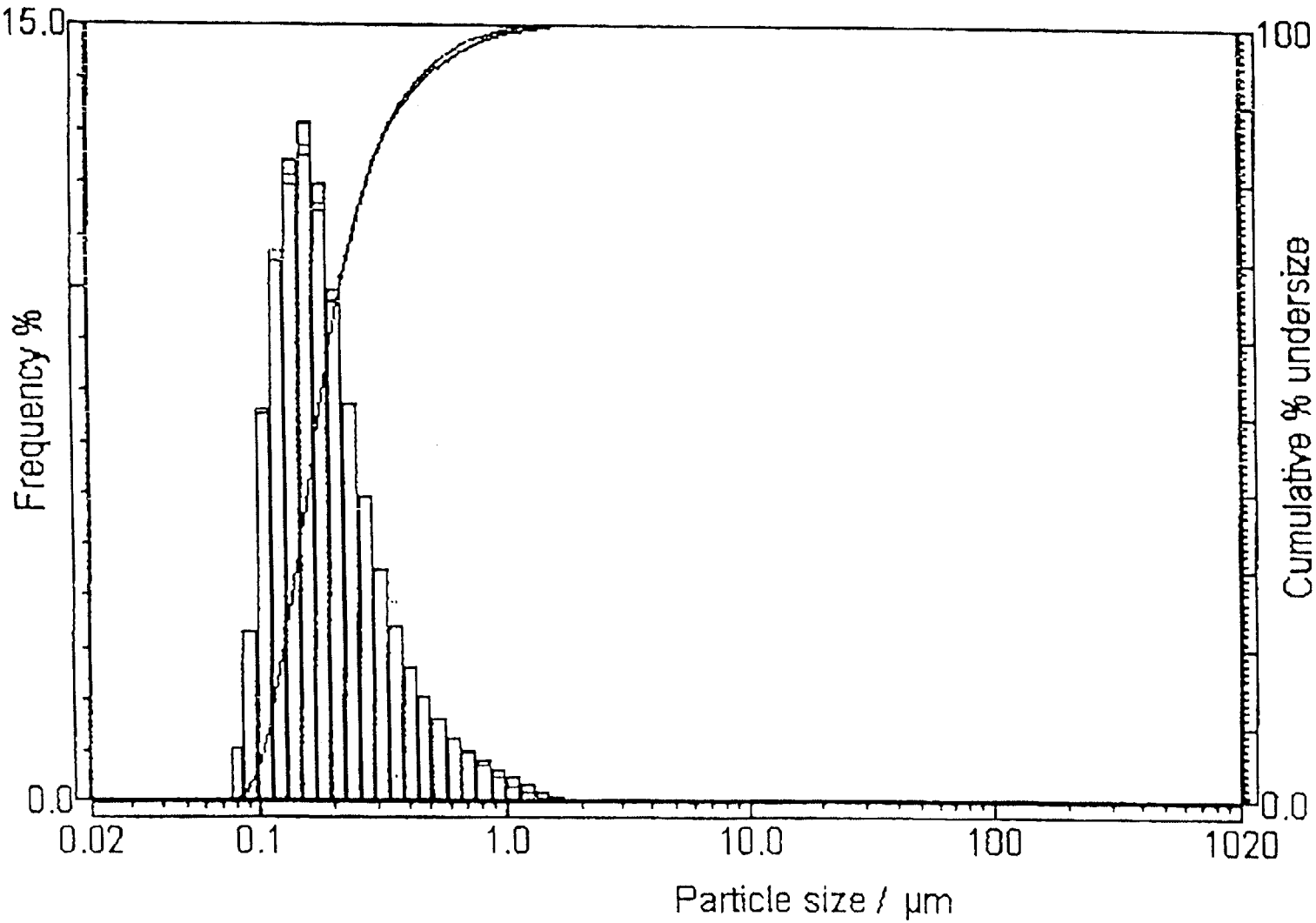
FIG. 4 is a histogram of particle size distribution for three slurries of Example 1.

A graphical depiction of the comparison of particle size distributions of the pre-drying concentrate, and the two reconstituted test slurries is shown in FIG. 4. The three materials are so close that the three distributions appear to be one.

Six weeks after spray drying, polishing tests were performed on the pre-drying slurry concentrate and the dried slurry sample Test I of the copper polishing slurry. The final concentrations of these slurries were adjusted to the following levels:

| | |
|---|---|
| Phosphoric acid: | 5.6% |
| Ammonium Phosphate | 4.3% |
| Ammonium persulfate: | 4.3% |
| Organic corrosion inhibitor | 0.15% |
| Titanium dioxide | 4.9% |
| D.I. water | Balance |

The spray dried slurry was measured out to obtain the above concentration and dispersed in a Hill rotor stator mixer to a delta T of 10° C. The residual, six week old concentrated slurry was diluted approximately 1 part concentrate to 1 part water to get the exact concentration noted above and mixed with a propeller mixer. All slurries were filtered through a 1 micron bag filter.

Six inch diameter copper film wafers were polished with each of the three slurries using a Strasbaugh 6EC Wafer Polisher (Strasbaugh, San Luis Obispo, Calif.) at identical polishing parameters. Also polished were silicon dioxide film wafers to establish the relative polishing rate between copper and silicon dioxide known as the oxide selectivity. The results of these tests are shown in Table 3. The polishing rates are listed in Angstroms per minute (A/min):

TABLE 3

| Slurry Origin | Copper Removal Rate | Selectivity to Oxide |
|---|---|---|
| Pre-drying concentrate, diluted to use conc. | 2200 A/min | 26:1 Cu:Oxide rate |
| Spray dried reconstituted slurry #I | 7049 A/min | 63:1 Cu:Oxide rate |

Typical removal rates for Copper polishing slurry are 6000 to 7000 A/min. The six week old concentrate had deteriorated considerably during that time as a one component mixture. The spray dried material had preserved the characteristics of the commercial two part slurry.

EXAMPLE 2

The second spray dried material known as Test II above was tested in a copper wafer polishing comparison nine weeks after it was dried. The test was run as a comparison of the reconstituted Test II material and a freshly mixed copper polishing slurry. The polishing was performed in essentially the same manner as before. The concentrations of the two slurries were made up to the end use concentration shown above. Results of the polishing tests are shown in Table 4 below:

TABLE 4

| Slurry Origin | Copper Removal Rate | Selectivity to Oxide |
|---|---|---|
| Fresh copper polishing slurry | 6100 A/min | 36:1 Cu:Oxide rate |
| Spray dried reconstituted slurry #II | 6600 A/min | 66:1 Cu:Oxide rate |

The surface finish of these wafers was also studied. There appeared to be no noticeable difference in surface scratching between the two slurries.

EXAMPLE 3

A Niro Mobile Minor Type H spray dryer was used in this test. This dryer was operated in a similar manner to the foregoing Examples. The polishing slurry in this test is used for polishing tungsten. The slurry used in this test was a ready to use formulation having the following constituents:

| | |
|---|---|
| Carboxylic acid | 3% |
| Carboxylic acid salt | 0.3% |
| Oxidizing component | 6% |
| Abrasive | 9% |
| D.I. Water | Balance |

A concentrate of this slurry was prepared for spray drying by doubling the concentrations of the chemical and abrasive components. The concentrate was then spray dried at several outlet temperature values to determine the degradation, if any, of the carboxylic acid components. The outlet temperature was varied by changing the feed rate of the concentrate and leaving all other parameters constant.

The dry flowable powders were reconstituted to the ready to use slurry composition shown above, and used to polish tungsten film wafers and thermal oxide film wafers. A portion of the original concentrate used to make the powders was also diluted to the ready-to-use concentration and used as the baseline. Table 6 below shows the results of the spray drying and polishing tests:

TABLE 5

| | Tungsten rate | Selectivity to ox. |
|---|---|---|
| Diluted concentrate from spray drying run | 2344 A/min | 416:1 |
| Freshly made slurry | 2177 A/min | 386:1 |
| Reconstituted spray dried powder | 2328 A/min | 346:1 |

Microscopic examination of the surfaces of the oxide film wafers after polishing showed no difference in scratching between any of the test wafers.

EXAMPLE 4

Several tests were performed in order to compare the polishing activity of a conventionally prepared tungsten polishing composition (designated as "MSW 2000") using a standard mix recipe and the same polishing composition prepared in accordance with the invention. The polished wafers were measured to determine the film removal rates, selectivity, surface roughness and defect formation.

A group of 200 mm test wafers were obtained, each having a 5000 angstrom base layer of thermal oxide overlying the wafer surface and an 8000 angstrom layer of tungsten separated from the thermal oxide by a 500 angstrom layer of titanium nitride.

To prepare for polishing the group of test wafers, a polishing pad IC-1400 K from Rodel, Inc. (Newark, Del.) was mounted onto the platen of a Strasbaugh 6DS-SP polishing system equipped with a four inch conditioning grid from Rare Earth Sciences, Inc. (formerly of Newark, Del.). In order to condition the pad, twenty pre-conditioning sweeps were made using a DI water rinse and five dummy oxide wafers followed by two dummy tungsten wafers were processed.

After the pad was initially conditioned, a group of thirteen 200 mm test wafers were polished. The test was carried out by first polishing a group of four control test wafers, using the conventionally prepared slurry, followed by polishing a group of five test wafers using slurry re-constituted in accordance with the invention. Finally, a second group of four control test wafers were polished using the conventionally prepared slurry. To help ensure that slurry on the surface of the pad did not carry over from one group to the next, two dummy oxide were processed between successive groups.

The following pad conditioning and polishing conditions were used during each test run:

| Polishing: | Pad Conditioning: |
|---|---|
| Down force: 7 psi | Down force: 14 lbs |
| Backpressure: 0 psi | Sweeps: 2 (post with DI water) |
| Platen speed: 60 rpm | Platen speed: 70 rpm |
| Carrier speed: 60 rpm | Disk speed: 75 rpm |
| Temperature: 100° F. | |

The test results are shown below in Table 6. The term "RR" is the removal rate of the tungsten (W), titanium (Ti) and oxide (Tox) thin films in Angstroms per minute. The removal rate of the thin film layers was determined using a SM-300 thin films measurement tool (KLA-Tencor, Fremont, Calif.). The average removal rate for the first, second and third groups of test wafers is shown in the columns labeled Avg. W, Avg Ti and Avg Tox. The test wafers labeled "-Recon" were polished using reconstituted polishing slurry prepared in accordance with the invention, while the remaining test wafers were polished using the conventional slurry.

TABLE 6

| Slurry | RR W | Avg W | RR Ti | Avg Ti | RR Tox | Avg Tox |
|---|---|---|---|---|---|---|
| MSW2000 | 2108 | | | | 110 | |
| MSW2000 | 2312 | | | | 109 | |
| MSW2000 | 2212 | | 275 | | 112 | |
| MSW2000 | 2338 | 2243 | 277 | 276 | 102 | 108 |
| MSW2000-Recon | 2176 | | | | 102 | |
| MSW2000-Recon | 2183 | | | | 115 | |
| MSW2000-Recon | 2193 | | | | 120 | |
| MSW2000-Recon | 2201 | | 334 | | 120 | |
| MSW2000-Recon | 2286 | 2208 | 361 | 348 | | 114 |
| MSW2000 | 2266 | | | | 119 | |
| MSW2000 | 2280 | | | | 118 | |
| MSW2000 | 2306 | | 297 | | 119 | |
| MSW2000 | 2331 | 2296 | 305 | 301 | 123 | 120 |

In order to determine any differences in surface roughness characteristics between the conventional and reconstituted polishing slurries, six test wafers were coated with a silicon oxide deposited using tetraethylorthosilane (TEOS) and subsequently polished. The test procedure was similar to that described above. Following each test, surface roughness tests were performed using an atomic force microscope (Model 5000, Digital Instruments, Inc., Santa Barbara, Calif.). Table 7 below contains a summary of the roughness values, where "Rms" is the root mean square value of surface roughness in nanometers:

TABLE 7

| Slurry | Rms (nm) |
|---|---|
| MSW2000 | 0.530 |
| MSW2000 | 0.542 |
| MSW2000-Recon | 0.537 |
| MSW2000-Recon | 0.600 |
| MSW2000 | 0.526 |
| MSW2000 | 0.558 |

The removal rate data shown in Table 6 and the surface roughness data shown in Table 7 indicates no measurable difference in polishing performance between the reconstituted slurry and the conventional slurry.

Thus it is apparent that there has been disclosed a polishing method using a reconstituted dry particulate polishing composition that fully provides the advantages set forth above. Although the foregoing Examples report the use of the present invention with chemical mechanical polishing slurries for integrated circuit applications, the invention enjoys applications in other types of polishing formulations. For example, many polishing compounds containing abrasives and chemicals, added to provide enhanced removal rates or special surface conditions, could be dried in a similar manner and reconstituted at the point of use. Abrasive slurries such as this are used for polishing specialty optics, for polishes involving semiconductor substrates such as silicon and gallium arsenide, for plastic eyeglass and contact lenses and other similar technologies. Accordingly, all such variations and modifications are within the scope of the appended claims and equivalents thereof.

What is claimed is:

1. A method of making a composition for polishing, comprising the steps of:

formulating a liquid polishing composition, drying the polishing composition to provide an amount of dry solids composition that is preserved by said drying, providing a batch amount of the dry solids composition comprising an amount of the dry solids composition that upon being reconstituted by the addition of water provides a batch amount of aqueous polishing composition corresponding to that which is substantially completely consumed while polishing a predetermined number of workpieces during a polishing cycle, and reconstituting the batch amount of dry solids composition by adding water thereto to form said batch amount of aqueous polishing composition for substantially complete consumption while polishing the predetermined number of workpieces during the polishing cycle.

2. The method as recited in claim 1, wherein the step of formulating a polishing composition further comprises the step of; formulating a concentrate of the polishing composition.

3. The method as recited in claim 1, further comprising the step of: qualifying the dry solids composition by analyzing an aqueous polishing composition, made by reconstituting some of the dry solids composition, for at least one physical property or at least one chemical property.

4. The method as recited in claim 1, further comprising the step of:

substantially completely consuming the batch amount of aqueous polishing composition while using the batch amount of aqueous polishing composition for polishing said predetermined number of workpieces during said polishing cycle.

5. The method as recited in claim 1, further comprising the steps of:

providing the dry solids composition in a package sized to contain an amount more than said batch amount of the dry solids composition, and providing said batch amount of the dry solids composition from the dry solids composition in the package.

6. The method as recited in claim 5, further comprising the step of:

substantially completely consuming the batch amount of aqueous polishing composition while using the batch amount of aqueous polishing composition for polishing said predetermined number of workpieces during said polishing cycle.

7. The method as recited in claim 1, further comprising the step of:

providing said batch amount of the dry solids composition in a package sized according to a size of said batch amount.

8. The method as recited in claim 7, further comprising the step of:

substantially completely consuming the batch amount of aqueous polishing composition while using the batch amount of aqueous polishing composition for polishing said predetermined number of workpieces during said polishing cycle.

9. The method as recited in claim 1, further comprising the step of: adding to the batch amount of aqueous composition a chemical selected from the group consisting of, hydrogen peroxide and organic acids.

10. The method as recited in claim 9, further comprising the step of: substantially completely consuming the batch amount of aqueous polishing composition to which said chemical has been added, while using the batch amount of aqueous polishing composition and said chemical for polishing said predetermined number of workpieces during said polishing cycle.

11. A method of making a composition for polishing, comprising the steps of:

formulating a liquid polishing composition, drying the polishing composition to provide an amount of dry solids composition that is preserved by said drying, providing a batch amount of the dry solids composition comprising an amount of the dry solids composition that upon being reconstituted by the addition of water provides a batch amount of aqueous polishing composition corresponding to that which is substantially completely consumed while polishing a predetermined number of workpieces during a polishing cycle, and qualifying the dry solids composition by analyzing an aqueous polishing composition, made by reconstituting some of the dry solids composition, for at least one physical property or at least one chemical property.

12. The method as recited in claim 11, wherein the step of formulating a polishing composition further comprises the step of; formulating a concentrate of the polishing composition.

13. The method as recited in claim 11, further comprising the step of:

reconstituting the batch amount of dry solids composition by adding water thereto to form said batch amount of aqueous polishing composition for substantially complete consumption while polishing the predetermined number of workpieces during the polishing cycle.

14. The method as recited in claim 13, further comprising the step of: substantially completely consuming the batch amount of aqueous polishing composition while using the batch amount of aqueous polishing composition for polishing said predetermined number of workpieces during said polishing cycle.

15. The method as recited in claim 11, further comprising the steps of:

providing the dry solids composition in a package sized to contain an amount more than said batch amount of the dry solids composition, and providing said batch amount of the dry solids composition from the dry solids composition in the package.

16. The method as recited in claim 15, further comprising the step of:

reconstituting the batch amount of dry solids composition by adding water thereto to form said batch amount of aqueous polishing composition for substantially complete consumption while polishing the predetermined number of workpieces during the polishing cycle.

17. The method as recited in claim 16, further comprising the step of: substantially completely consuming the batch amount of aqueous polishing composition while using the batch amount of aqueous polishing composition for polishing said predetermined number of workpieces during said polishing cycle.

18. The method as recited in claim 11, further comprising the step of:

providing said batch amount of the dry solids composition in a package sized according to a size of said batch amount.

19. The method as recited in claim 18, further comprising the step of:

reconstituting the batch amount of dry solids composition by adding water thereto to form said batch amount of aqueous polishing composition for substantially complete consumption while polishing the predetermined number of workpieces during the polishing cycle.

20. The method as recited in claim 19, further comprising the step of:

substantially completely consuming the batch amount of aqueous polishing composition while using the batch amount of aqueous polishing composition for polishing said predetermined number of workpieces during said polishing cycle.

21. The method as recited in claim 11, further comprising the step of: adding to the batch amount of aqueous composition a chemical selected from the group consisting of, hydrogen peroxide and organic acids.

22. The method as recited in claim 21, further comprising the step of: substantially completely consuming the batch amount of aqueous polishing composition to which said chemical has been added, while using the batch amount of aqueous polishing composition and said chemical for polishing said predetermined number of workpieces during said polishing cycle.

* * * * *